US005756926A

United States Patent [19]

Bonbrake et al.

[11] Patent Number: 5,756,926

[45] Date of Patent: May 26, 1998

[54] EFI DETONATOR INITIATION SYSTEM AND METHOD

[75] Inventors: Tim B. Bonbrake; Matthew R. Williams; Duane A. Gerig, all of Fort Wayne, Ind.

[73] Assignee: Hughes Electronics, Los Angeles, Calif.

[21] Appl. No.: 760,772

[22] Filed: Dec. 5, 1996

Related U.S. Application Data

[63] Continuation of Ser. No. 415,270, Apr. 3, 1995, abandoned.

[51] Int. Cl.[6] ..... F42D 1/05

[52] U.S. Cl. ..... 102/215; 175/3; 102/206

[58] Field of Search ..... 102/200, 202.1, 102/202.2, 202.4, 215, 217, 301, 313, 206; 89/1.15; 175/2, 3, 4.55

[56] References Cited

U.S. PATENT DOCUMENTS

| | | | |
|---|---|---|---|
| 2,796,023 | 6/1957 | Abendroth | 89/1.15 |
| 3,262,388 | 7/1966 | McCarty . | |
| 3,860,865 | 1/1975 | Stroud et al. . | |
| 3,883,791 | 5/1975 | Zelina et al. | 321/5 |
| 4,078,189 | 3/1978 | Nash et al. | 318/227 |
| 4,304,184 | 12/1981 | Jones | 102/202.13 |
| 4,431,982 | 2/1984 | Monroe et al. | 338/214 |
| 4,601,243 | 7/1986 | Ueda et al. | 102/200 |
| 4,848,232 | 7/1989 | Kurokawa et al. | 102/200 |
| 5,022,485 | 6/1991 | Mitchell | 181/106 |
| 5,079,410 | 1/1992 | Payne et al. | 219/506 |
| 5,385,097 | 1/1995 | Hruska et al. | 102/202.5 |
| 5,431,104 | 7/1995 | Barker | 102/312 |
| 5,458,122 | 10/1995 | Hethuin | 128/696 |
| 5,533,454 | 7/1996 | Ellis et al. | 102/202.1 |

*Primary Examiner*—Michael J. Carone
*Assistant Examiner*—Christopher K. Montgomery
*Attorney, Agent, or Firm*—Leonard A. Alkov; William C. Schubert; Glenn H. Lenzen, Jr.

[57] ABSTRACT

In one aspect of the invention, an environmentally insensitive initiator, including: an electro-explosive device responsive to an electrical signal of unique voltage and frequency applied to the electro-explosive device, the unique voltage and frequency being such that are not otherwise present in a well completion operation. An example of voltage and frequency is 350V at 900 Hz. In another aspect, an initiator insertable in a housing insertable in a well casing, the initiator having a contact which is grounded when the initiator is uninstalled, to protect against unintended currents, but which becomes ungrounded by the act of inserting the initiator in the housing. In a further aspect, an initiator including a dual-function fuse. In the first function, the fuse permits a prefire, low-current, continuity test through electrical circuitry without applying electrical energy to the initiating element, but an internal element of the fuse will open if an unintended higher current, above a threshold, is applied to the fuse. In the second function, the fuse is destroyed as a result of the detonator charge being detonated, permitting a post fire test to verify detonation of the detonator charge by sensing the destruction of the fuse. In an additional aspect, a circuit card assembly protected against physical damage.

2 Claims, 7 Drawing Sheets

EFI DETONATOR INITIATION SYSTEM AND METHOD

This application is a continuation of application Ser. No. 08/415,270, filed Apr. 3, 1995, now abandoned.

BACKGROUND OF THE INVENTION

1. Field of the Invention

The present invention relates to oil and gas well completion operations generally and, more particularly, but not by way of limitation, to novel means and method for activating a pyrotechnic or explosive tool (hereinafter "tool") disposed in a well casing.

2. Background Art

After a well borehole has been drilled to a specified depth, a perforating shaped explosive charge is used to form a jet perforation blast extending radially outwardly, which blast punctures the well casing, the cement on the exterior of the casing, and adjacent formations, with the view of initiating fluid or vapor flow into the casing from a geological formation of interest. It is an important sequential step which can cause loss of life, severe damage to the well, and/or disruption of completion schedules, if misfired at the wrong time or at the wrong location in the well.

Existing initiation systems utilize current/voltage sensitive detonators (sometimes called blasting caps) which contain primary explosives, or relatively insensitive exploding foil initiator (EFI) type slapper detonators which contain secondary explosives, to initiate the well tools. The standard blasting cap detonator is extremely sensitive to any environmental stimuli, including heat, sparks, friction, shock, and electrical current of any type. This sensitivity precludes the performance of electrical testing of the blasting cap during or following installation of the detonator in the tool, due to the inherent safety hazard presented. The use of the blasting cap also requires the complete shutdown of all radio transmitting devices and well equipment, due to the risk of premature detonation caused by electromagnetic radiation at any frequency and stray ground currents at 50/60 Hz or DC, which can be generated by the well equipment.

Firing the explosive device which initiates the tool is accomplished in existing initiation systems by connecting an AC or DC voltage across the wireline or other electrical terminals. Existing systems designed to initiate blasting caps utilize either a DC voltage of 0 to 220 volts or a 50/60 -Hz AC voltage of 0–240 volts. Since voltages and power of this type are commonly available on the well platform, a safety hazard is possible if the wireline or other electrical terminals come(s) in contact with any portion of the well structure that may have voltage present. Presently, when well pyrotechnic or explosive operations are performed, all non-essential equipment is shut down to reduce the potential for stray voltages and currents from inadvertently initiating the blasting cap and tool. Existing slapper detonator systems have improved upon the blasting cap sensitivity by requiring large DC voltages (200 V) or AC voltages to be present for a period of time. This is still undesirable because 50/60 -Hz AC voltages and DC voltages are present in other equipment on the well platform and still may present a safety hazard if the wireline or other electrical terminals were to come in contact with some stray voltages.

Blasting caps are also subject to premature detonation, due to the high ambient temperatures normally associated with downhole conditions. The conventional slapper detonators and firing systems developed for use with well tools are also subject to several of these conditions, albeit to a much lesser degree. These systems are designed to be fired by placing a large DC or AC voltage on the wireline. Neither of these firing signals is uniquely generated for only firing the slapper detonator and none contains electrical measurement capabilities to determine the status of the detonator. The conventional slapper detonator systems are not able to function above 175° C., whereas many wells are at temperatures in excess of 200° C.

Because of the sensitivity of the standard blasting caps, performing any continuity check of the blasting cap in circuit could be potentially lethal to the operator and/or cause severe damage to surrounding structures if such a test were performed. Although the risk of detonation during a continuity check would not be as prevalent with a slapper detonator system, there is no known system which has incorporated such a test feature. As a result, the operator has no verifiable detection method to assure: (1) there are no electrical open or short circuits in the system following the installation of the detonator; (2) the detonator has been electrically installed properly prior to placing the tool in the well; (3) and the detonator has fired after an initiation signal has been presented to the blasting cap or slapper detonator. The post fire characteristics of the blasting cap are to either open or short circuit, neither of which is detectable, due to the relatively low impedance (less than 2 Ohms) of the blasting cap and the variable resistance characteristic of the deployed wireline. The standard wireline is an electromechanical cable with center conductor wire surrounded by insulation, with a multiple layer uninsulated armor shield around the outside. The resistance of the wireline is dependent on wireline size and length, and the amount of line which is deployed to fire the tool. While the selected wireline size and length are fixed for any one operation, the resistance change due to the deployed length is an unknown variable, determined by the resistance of the bare armor braid which has been reeled out and the shield-to-shield contact resistance of the cable remaining on the spool. With wireline lengths of 1000 to 30,000 feet, this variable resistance can vary from approximately 2 to 130 Ohms, which is much greater than the approximately 1-Ohm bridge resistance of the standard blasting cap.

The advantages of having the capability to perform a prefire system test and post fire detonation detection are: (1) reduced time and cost in placing a defective and/or improperly installed initiation device in a tool, positioning the tool in the well, firing the tool, and removing the tool from the well, only to find that the unit did not function, the procedure to install, position, fire, and remove taking several hours to perform; and (2) reduced time and cost in preparing an alternate tool to perform the task if the post fire detonator detection tests indicate the initiating device did not fire, the preparing of a new tool being performed during the 30 to 60 minutes required to bring the failed unit out of the well. U.S. Pat. No. 3,860,865 describes a continuity test method in which a test current is placed directly on a blasting cap bridge through a network of switches, diodes, and resistors. Post fire detection is determined by a change in resistance caused by a shock sensitive switch switching in alternate firing circuitry networks, the shock being transmitted to the switch through an inert medium (well bore fluid and tool casing). Neither test is particularly reliable and the former test has the potential for causing unintended detonation.

Accordingly, it is a principal object of the present invention to provide detonator initiation method and means which are relatively safe and insensitive to environmental hazards.

It is a further object of the invention to provide method and means for prefire and post fire testing of a detonator initiation system which assure that the detonator and its safety features are properly connected and operational and which positively indicate that detonation has occurred.

It is an additional object of the invention to provide physical protection for a circuit card which may be employed in an initiator.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in one preferred embodiment, an environmentally insensitive detonator initiation system for use in a well completion operation, comprising: an electro-explosive device for placement in a well casing to cause detonation of a main explosive charge therein in response to an electrical signal of unique voltage and frequency applied to said electro-explosive device; and means to apply said unique electrical signal to said electro-explosive device, said unique electrical signal having a voltage which is not common to normal DC and 50/60 -Hz power sources, having a frequency which is below normal communication and RF frequencies associated with transmitting devices, and having said voltage and said frequency which are not otherwise present in a well completion operation. In another aspect of the invention, there is provided an environmentally insensitive detonator initiation apparatus for use in a well completion operation, comprising: initiator means insertable in housing means insertable in a well casing, said initiator means to cause detonation of a main explosive charge in said well casing in response to said initiator means receiving a predetermined electrical signal on said wireline; and contact means disposed in said initiator means to contact said wireline, when said contact initiator means is inserted in said housing means, and receive said predetermined electrical signal and to transmit the same to electrical circuitry disposed in said initiator means, said contact means being movable between a first position, before said initiator means is inserted in said housing means, in which first position said contact means is in electrical engagement with an electrically grounded portion of said initiator means so as to protect said electrical circuitry against stray currents, static discharges, and EMI hazards, and a second position, to which said second position said contact means is moved by the insertion of said initiator means in said housing means, and in which said second position said contact means is disengaged from said electrically grounded portion so as to be able to transmit said predetermined electrical signal to said electrical circuitry. In a further aspect of the invention, there is provided in a detonator initiation system of the type having an electro-explosive device including therein a detonator charge and electrical circuitry to provide an electrical charge to an initiating element in proximity to said detonator charge, the improvement comprising: fuse means comprising part of said electrical circuitry and having first and second distinct functions; in said first function, said fuse means is part of an electrical path through said electro-explosive device, so as to permit a prefire, low-current, continuity test therethrough without applying electrical energy to said initiating element, but an internal element of said fuse means will open if an unintended higher current, above a threshold, is applied to said fuse means; and in said second function, said fuse means is destroyed as a result of said detonator charge being detonated, so as to permit a post fire test to verify detonation of said detonator charge by sensing the destruction of said fuse means. In an additional aspect of the invention, there is provided a circuit card assembly protected against physical damage, comprising: a circuit card having electrical components mounted thereon; resilient pads disposed about said circuit card and closely conforming to said circuit card and said electrical components; and a tubing tightly disposed about said resilient pads and compressing the same into conformance with said circuit card and said electrical components.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
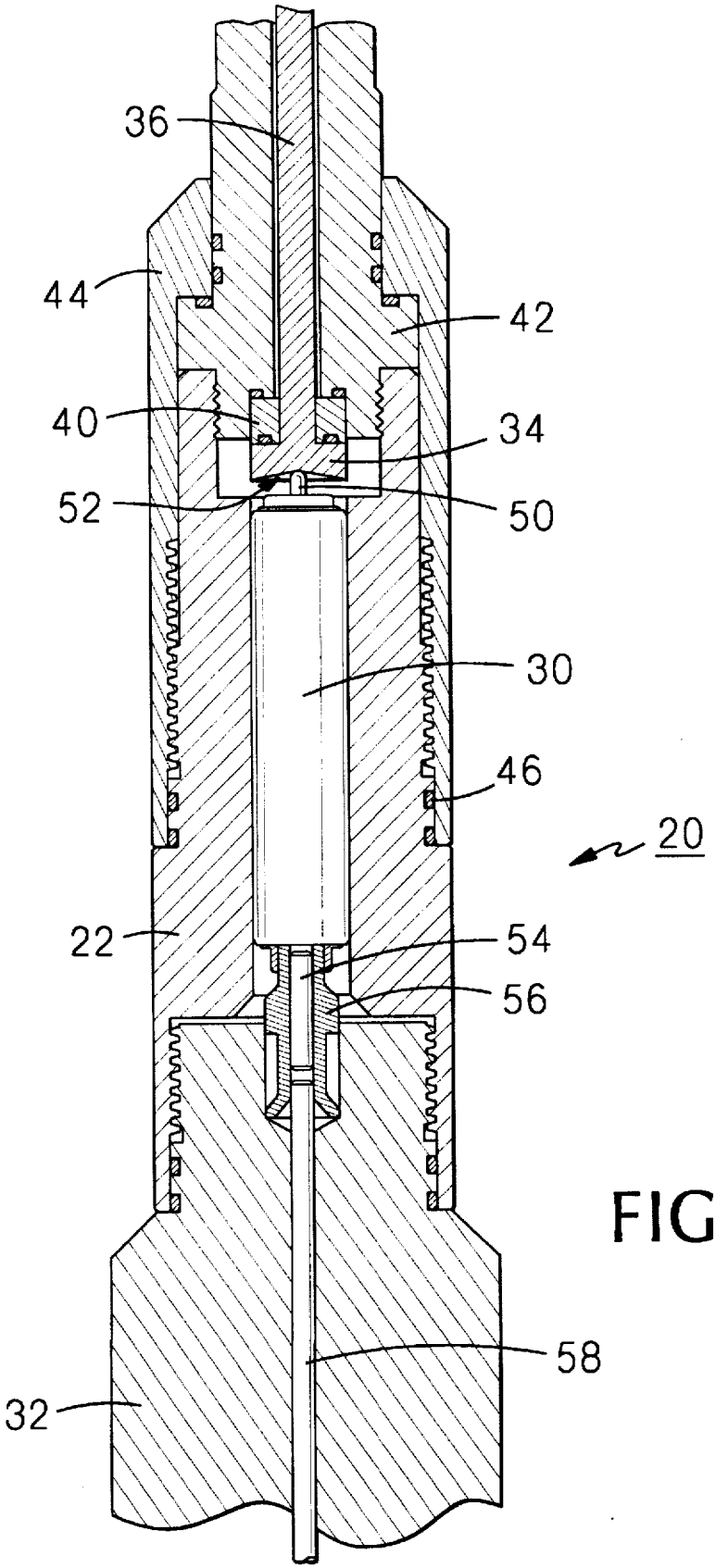
FIG. 1 is a fragmentary, side elevational, cross-sectional view of an initiator constructed according to the present invention and shown installed for use.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an assembly generally indicated by the reference numeral 20. Assembly 20 includes a main body portion 22 in which is disposed an initiator cartridge 30 constructed according to the present invention. Threadingly attached to the lower end of main body portion 22 is a tool 32 of conventional construction for forming a plurality of apertures in a well casing (not shown). A wireline center contact 34 is disposed in the upper end of main body portion 22 and is the termination of a wireline 36 comprising a shielded armored cable which extends from the earth's surface from electrical control/actuating circuitry (not shown on FIG. 1) and which supports assembly 20 in the well casing. Wireline center contact 34 is secured in place by an insulating member 40 which is held in the lower end of an end plug 42 which is threadingly inserted in the upper end of main body portion 22. An end cap 44 engages end plug 42 and is threadingly attached to the outer periphery of main body portion 22 to provide additional structural support for assembly 20. Several 0-rings, as at 46, are provided for conventional sealing purposes.

Wireline center contact 34 is in electrical engagement with a contact pin 50, extending from the upper end of initiation cartridge 30, the upper end of which contact pin is inserted in a V-shaped depression 52 formed in the lower face of the wireline center contact. Disposed in proximity to the lower end of initiation cartridge 30 is an explosive booster charge 54 held in a booster charge retainer 56 disposed in the upper end of tool 32. A detonating fuse 58 extends from near booster charge 54 to the interior of tool 32.

As will be explained in detail below, electrical current supplied to contact pin 50 of initiation cartridge 30 causes booster charge 54 to detonate which, in turn, ignites detonating fuse 58 which, in turn, causes shaped charges (not shown) in tool 32 to detonate, the latter causing perforation of the well casing.

Figure 2:
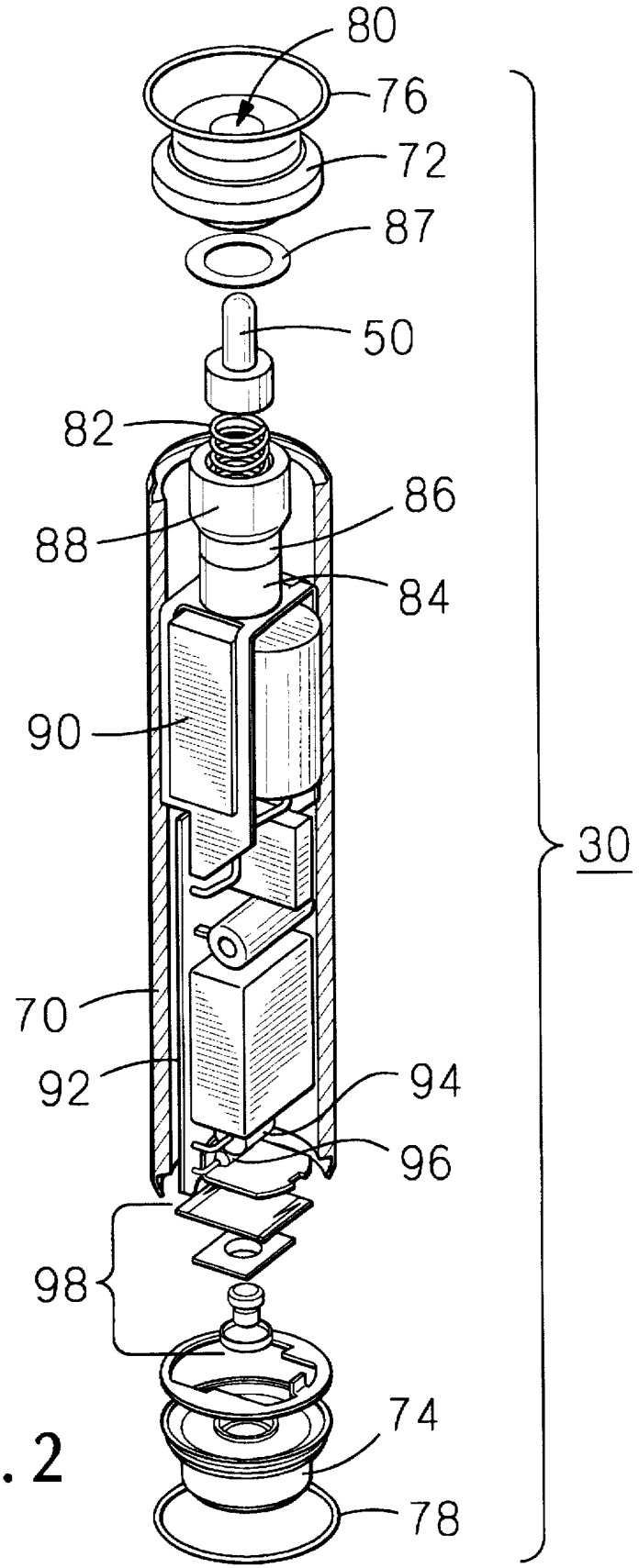
FIG. 2 is an exploded, partially cut-away, isometric view of the initiator.

FIG. 2 illustrates the elements of initiator cartridge 30 which include a hollow cylindrical housing 70 having upper and lower end closures 72 and 74, respectively, and associated 0-rings 76 and 78. Contact pin 50 is biased to extend through an opening 80, defined through upper end closure 72, and to engage wireline center contact 34 (FIG. 1) by means of a spring 82 extending between the lower end of the contact pin and a contact sleeve 84 inserted in an insulating sleeve 86 which is itself inserted in a metallic retainer 88. As is more evident from inspection of FIG. 3, an insulating washer is disposed between the upper end of contact sleeve 84 and the inside surface of upper closure 72 when initiator cartridge 30 is assembled. Electrical and electromechanical components included in housing 70 include a transformer/rectifier 90, a circuit card assembly 92, an overvoltage switch 94, a dual-function safing fuse 96, and a slapper detonator 98 in proximity to the safing fuse. Slapper detonator 98 is disposed in the lower end of initiator cartridge 30 and is adjacent booster charge 56 (FIG. 1) in tool 32 (FIG. 1) to cause the detonation thereof.

Figure 3:
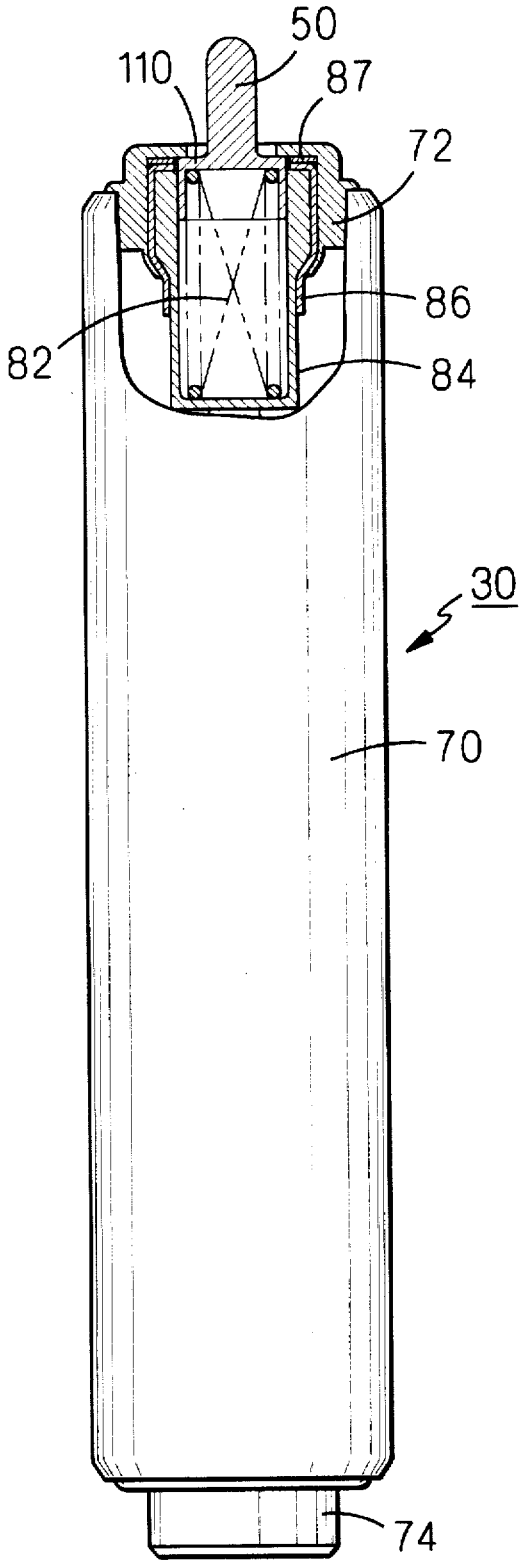
FIGS. 3 and 4 are side elevational views, partially cut-away and partially in cross-section, of the initiator before and after installation, respectively.
Figure 4:
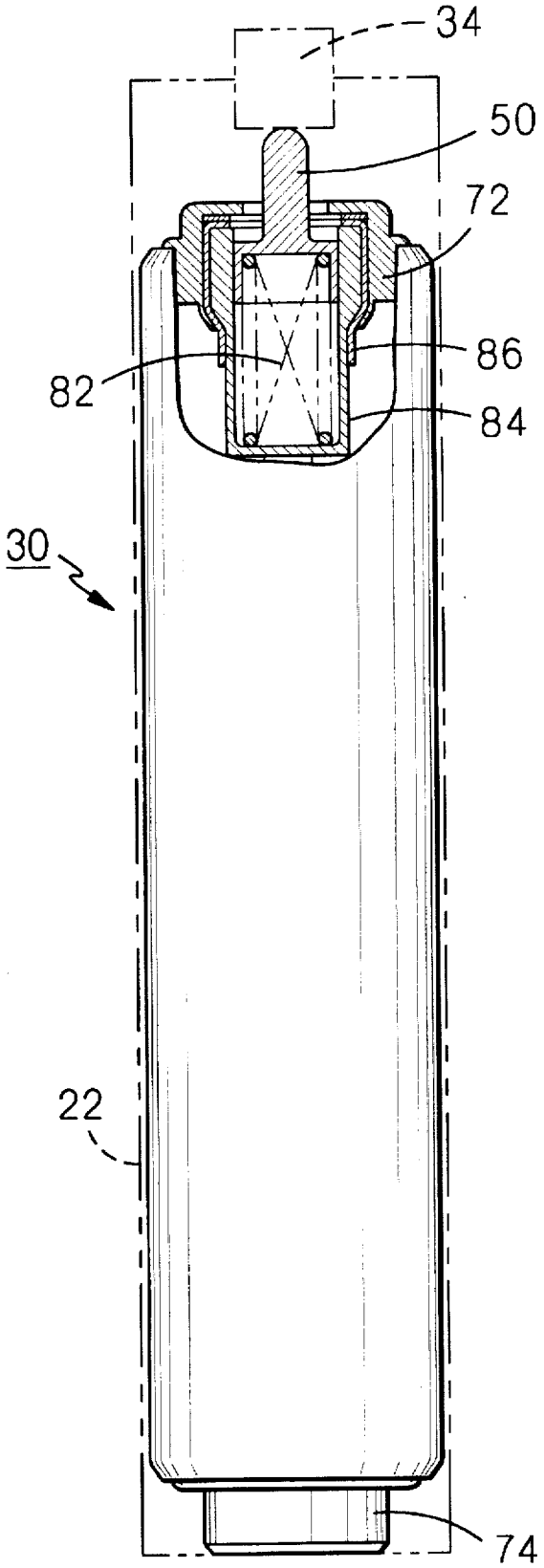

FIGS. 3 and 4 show, respectively, initiation cartridge 30 before and after installation in assembly 20 (FIG. 1) and illustrate one of the safety features of the present invention. In the pre-installation state of initiator cartridge 30 shown on FIG. 3, spring 82 biases contact pin 50 so that a shoulder 110 formed on the contact pin engages the inner surface of upper end closure 72, thus electrically grounding the contact pin to housing 70. Since contact pin 50 is electrically connected to the elements of initiator cartridge 30 which cause slapper detonator 98 (FIG. 1) to detonate, this grounding protects against unintended detonation resulting from stray currents, static discharges, and EMI hazards. As indicated on FIG. 4, when initiator cartridge 30 is inserted in main body portion 22, the relative dimensions of assembly 20 (FIG. 1) are such that wireline center contact 34 pushes against contact pin 50, compressing spring 82, such that shoulder 110 on the contact pin disengages the inner surface of upper closure 72, thus opening the electrical short. Insulating sleeve 86 electrically isolates the bore in contact sleeve 84 from upper closure 72. If initiator cartridge 30 is removed from main body portion 22, spring 82 re-seats shoulder 110 of contact pin 50 against the inner surface of upper closure 72, automatically restoring the electrical short and the concomitant protection.

Figure 5:
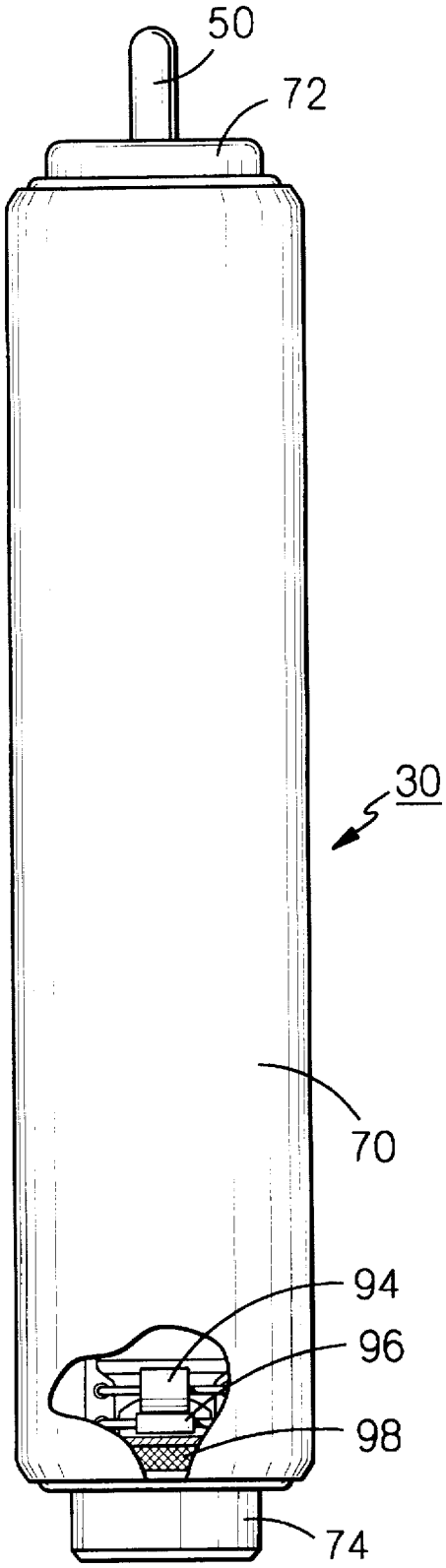
FIGS. 5 and 6 are side elevational views, partially cut-away, of the initiator before and after detonation, respectively.
Figure 6:
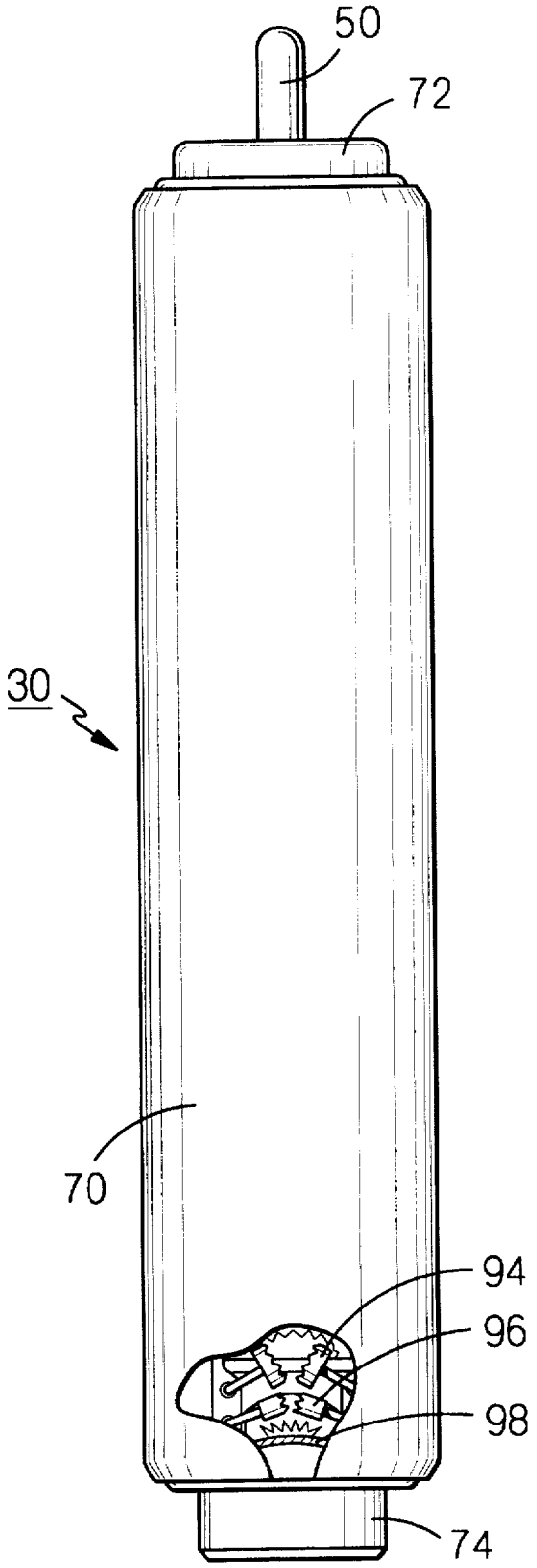

FIGS. 5 and 6 illustrate, respectively, initiation cartridge 30 prior to and after detonation. Shown in the cutaway portion of the figures are overvoltage switch 94, dual function safing fuse 96, and slapper detonator 98. Dual function fuse 96 performs two distinct system functions. In its first role, fuse 96 functions to interrupt current flow through it when a given current threshold is exceeded. This is the typical function of an electrical fuse and fuse 96 interrupts current flow through it by severing the internal conductive member (not shown) within it when current flow through that member causes resistive heating to raise the temperature of the member above the melting point of the material from which the member is fashioned. By placing fuse 96 in physical proximity to slapper detonator 98, the fuse serves a second function. When slapper detonator 98 is detonated, the pressure field generated fractures fuse 96 and the conductive member therein (and, coincidentally, overvoltage switch 94). The destruction of fuse 96 permits a post-fire detonation detection test to be conducted to verify detonation. U.S. Pat. No. 3,262,388 describes the use of a resistor to sense the explosive function of a detonating device, but the use of a fuse for the dual functions has been unknown heretofore.

Figure 7:
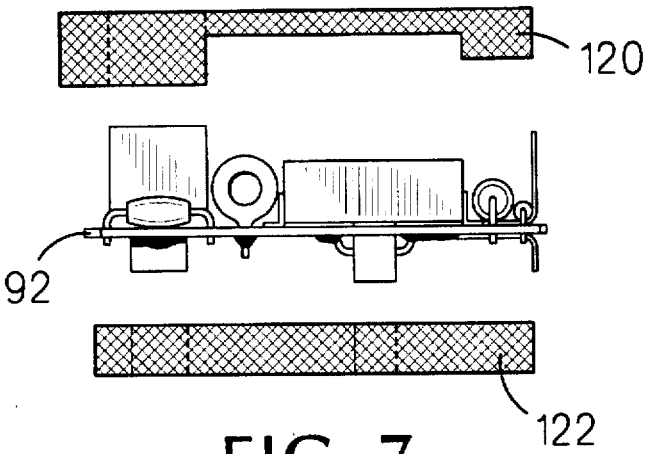
FIGS. 7, 9, and 11 are side elevational views
Figure 8:
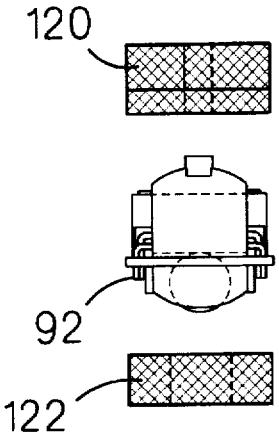
FIGS. 8, 10, and 12 are end elevational views of steps in forming protective packaging for electrical circuitry for the initiator.
Figure 9:
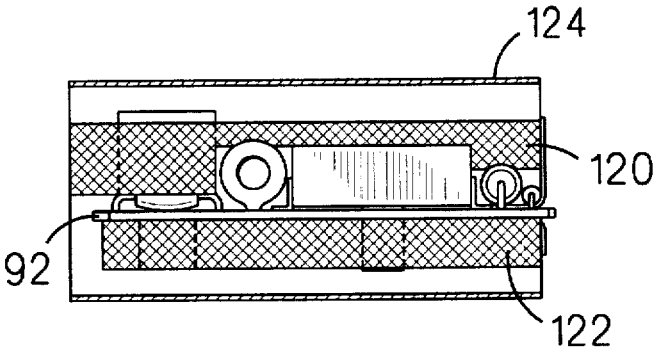
Figure 10:
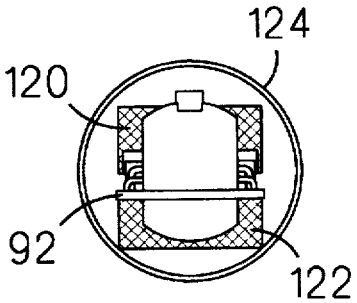
Figure 11:
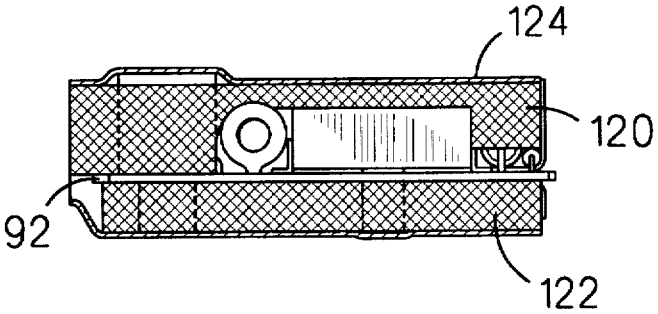
Figure 12:
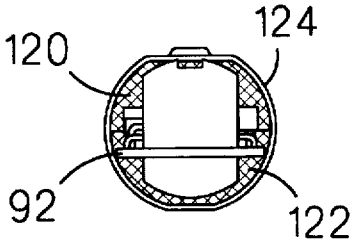

FIGS. 7–12 illustrate a "pack-in-place" method of packaging electronic components of initiator cartridge 30 (FIG. 2) so that they are protected and cushioned against damage. The method pots circuit card 92 between upper and lower foam pads 120 and 122, respectively, surrounded by a length of heat shrinkable tubing 124. FIGS. 7 and 8 show circuit card 92 and pads 120 and 122 before placing the latter on the circuit card. Pads 120 and 122 are of rectangular parallelepipedon shape which permits their being fabricated by stamping from a sheet of suitable material, a method of manufacture which possesses cost advantages over molding the pads into non-standard custom shapes. FIGS. 9 and 10 show pads 120 and 122 in place on circuit card 92, with some of the components on the circuit card protruding into cutouts defined in the pads, and with unshrunk tubing 124 therearound. The inner diameter of tubing 124 is chosen such that it clears pads 120 and 122 and the protruding components, promoting ease of installation. FIGS. 11 and 12 show the final package, with tubing 124 shrunk around pads 120 and 122. As tubing 124 shrinks, it contacts the corners of pads 120 and 122 and compresses the rectangular cross-sections of the pads into the arcuate forms illustrated on FIG. 12. The compression of pads 120 and 122 by shrinking tubing 124 also forces the pads to conform tightly against the irregular surfaces of the components on circuit card 92. In this fashion, circuit card 92 is encased in a shock absorbing cushion suited for insertion into housing 70 (FIG. 2) of initiator cartridge 30. Tubing 124 is chosen such that the resulting assembly possesses an effective outer diameter slightly larger than the inner diameter of housing 70. This arrangement results in an interference fit between the assembly and housing 70, ensuring that the assembly is frictionally retained snugly within the housing.

"Pack-in-place" potting has been used in industry for many years; however, the present method used to conformly form the potting around circuit card 92 has not been known heretofore.

Figure 13A:
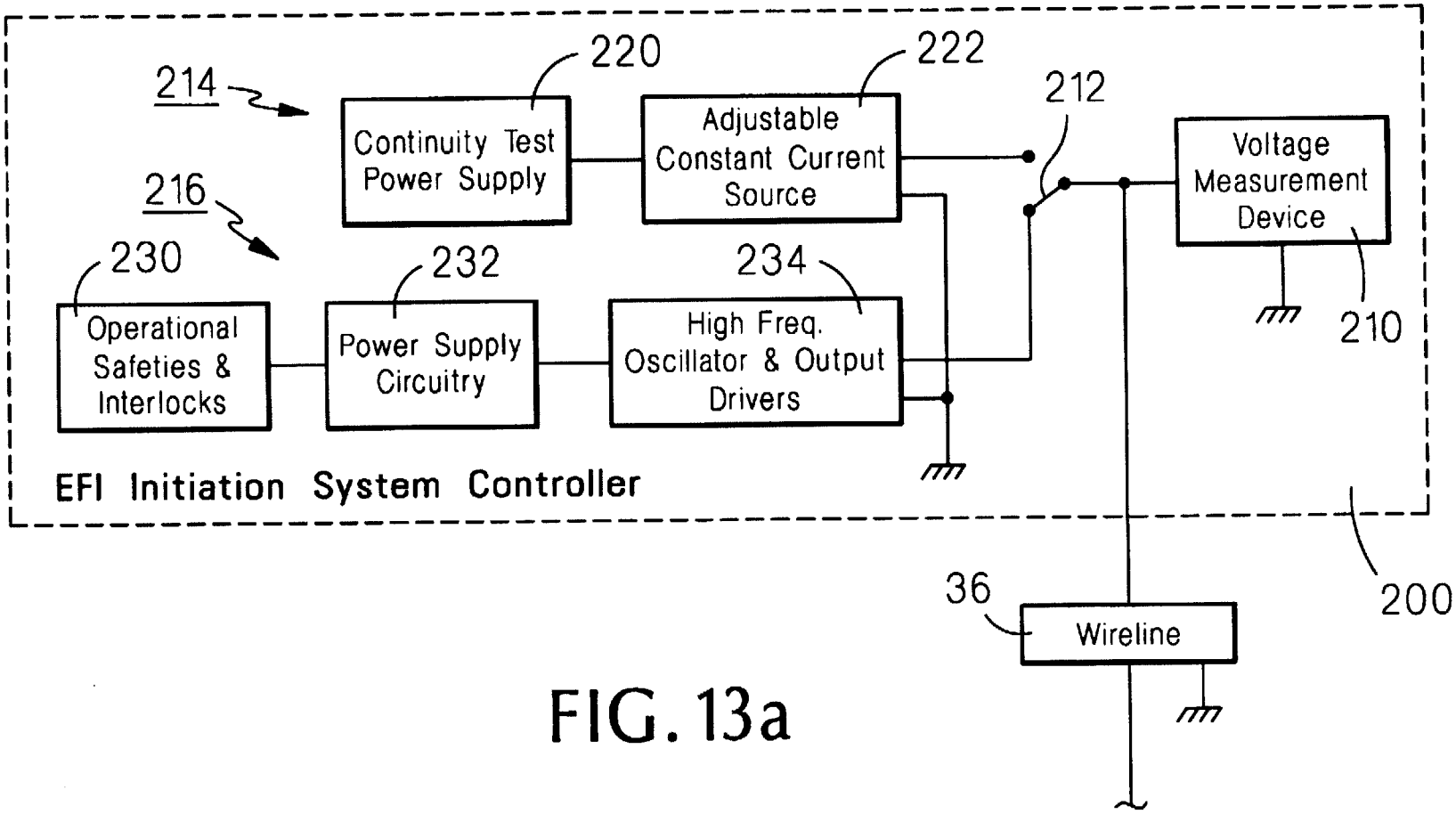
FIG. 13 is a block/schematic diagram illustrating the electrical circuitry and operation of the system of which the initiator is a part.
Figure 13B:
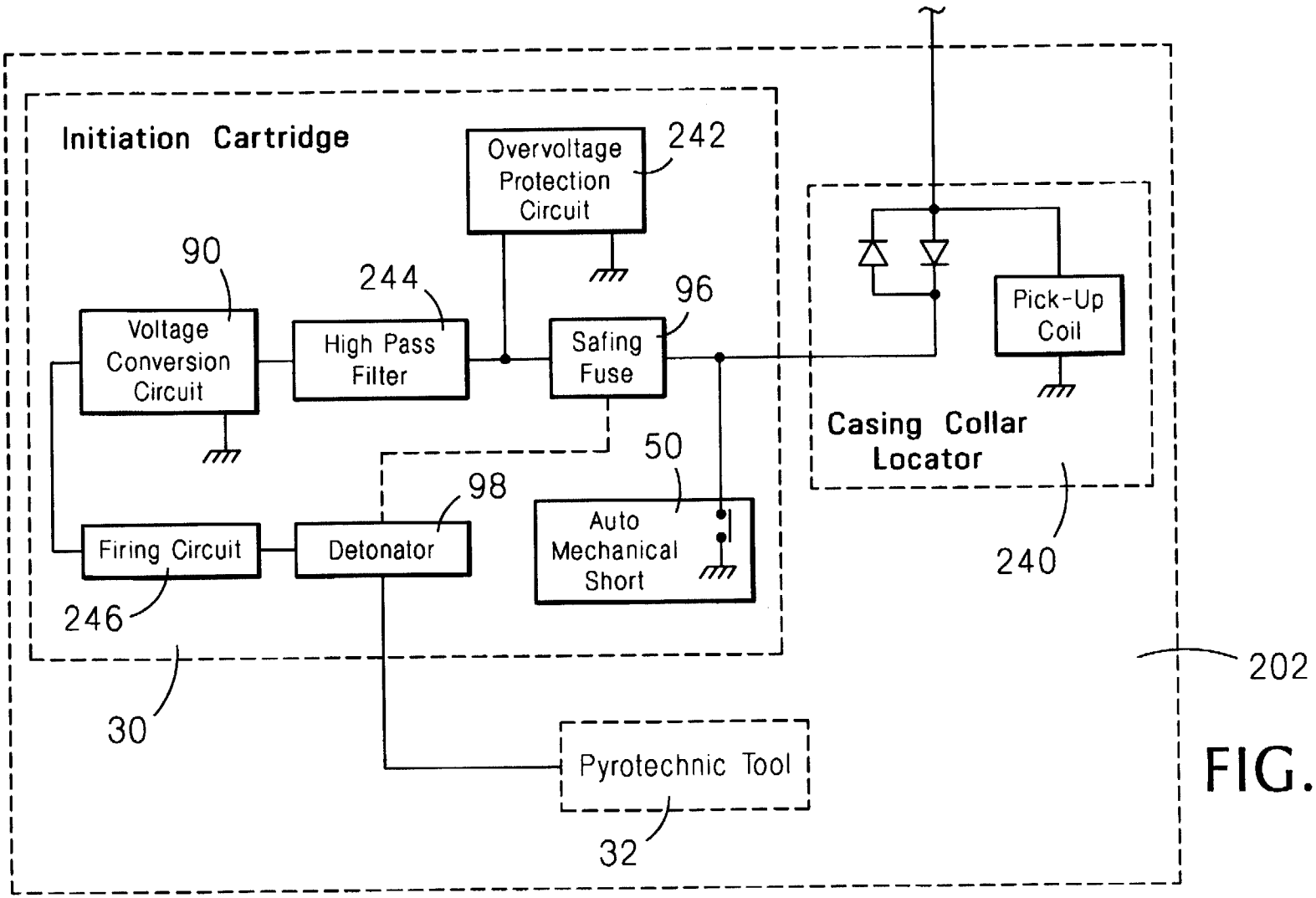

Reference should now be made to FIG. 13 for an understanding of the control circuitry and operation of the system of the present invention.

The upper large block 200 on FIG. 13, labelled "EFI Initiation System Controller", contains the elements of the system which are disposed above the earth's surface. The lower large block 202 on that figure contains the elements of the system which are located below the earth's surface in the well casing (not shown). The elements of blocks 200 and 202 are connected by wireline 36. Elements shown on FIG. 13 which have reference numerals less than "200" have been described above in connection with the discussions of FIGS. 1–6.

Controller 200 includes a voltage measurement device 210 connected to the upper terminating end of wireline 36 and to a two-position switch 212 which may be selectively connected to a test circuit, generally indicated by the reference numeral 214, or to an activating circuit, generally indicated by the reference numeral 216.

Test circuit 214 includes a continuity test power supply 220 and an adjustable constant current source 222, the test circuit having two functions. The first function is to verify, in conjunction with voltage measurement device 210, circuit continuity by measuring resistance change as initiator cartridge 30 is installed and contact pin 50 is disengaged from upper closure 72 (FIGS. 3 and 4). The second function is to verify, again in conjunction with voltage measurement device 210, that initiator cartridge 30 has fired by determining that safing fuse 96 has been destroyed.

Activating circuit 216 includes operational safeties and interlocks 230, controlled by an operator (not shown), coupled to a 110-V, 50/60 -Hz power supply 232 and high frequency oscillator and output drivers 234 to provide the necessary actuating current to initiator cartridge 30, with circuit 234 ramping the power to the actuating conditions to keep transformer 90 (FIG. 2) from going into saturation.

Wireline 36 is serially connected to a conventional casing collar locator 240, the purpose of which is to provide input for determination, by conventional means (not shown) of the elevation of the elements of block 202 in the well casing by sensing the joints between sections of the well casing. After casing collar locator 240, wireline 36 is connected to safing fuse 96 (FIGS. 5 and 6) and to a automechanical short comprising contact pin 50 and associated elements (FIGS. 3 and 4). Safing fuse 96 is connected to an overvoltage protection circuit 242, which includes overvoltage switch 94 (FIG. 2) and a high pass filter 244, which is an RC circuit. High pass filter 244 is coupled to a voltage conversion circuit which includes transformer/rectifier 90 (FIG. 2) and which is coupled to a firing circuit 246 comprising a capacitor which provides detonating current to slapper detonator 98. Initiator cartridge 30 contains a series DC current path through safing fuse 96, the DC resistance of high pass filter 244, and voltage conversion circuit 90. The broken line between slapper detonator 98 and safing fuse 96 is provided to indicate the destruction of fuse 96 upon detonation of the slapper detonator (FIGS. 5 and 6).

To perform prefire system tests, all electrical connections are made, with the exception of the installation of initiator cartridge 30, and controller 200 is connected to wireline 36. With controller 200 in the test mode, constant current source 222 is adjusted until voltage measurement device 210 indicates a voltage of predetermined value. Then, controller 200 is turned off and initiator cartridge 30 is installed. Following installation of initiator cartridge 20, controller 200 is placed in the test mode and the deviation in voltage measurement device 210 is determined. If the pre/post install voltage deviation is within specified boundaries, a pass indication is obtained; otherwise, a fail indicated is obtained. The foregoing test is performed above ground, so that any corrective measures can be easily taken.

After installation of the downhole components (Block 202) in the well casing, a second continuity prefire test is performed to verify readiness of the system, the DC test path for which includes wireline 36, casing collar locator 240, safing fuse 96, high pass filter 244, and voltage conversion circuit 90. If automechanical short 50 is closed (cartridge 30 no longer installed properly), voltage measurement device 210 will indicate a relatively low voltage drop. If auto mechanical short 50 is open and the other elements in the test path are functional, some higher, predetermined voltage drop will be obtained.

To perform post fire systems tests, immediately prior to the initiation of initiator cartridge 30, controller 200 is placed in the test mode and constant current source 222 is adjusted until voltage measurement device 210 indicates a voltage of a predetermined value. This re-adjustment from the above ground setting is required to compensate for the increase in resistance of the armor shield of wireline 36, resulting from the wireline deployment down the well. With constant current source 222 set to provide a specific voltage to the system, controller 200 is placed in the fire mode and the firing sequence is initiated. Initiation cartridge 30 may provide either an open circuit or a short circuit upon detonator initiation. A short circuit condition will obtain if the leads of safing fuse 96 contact housing 70 (FIG. 2) upon destruction of the safing fuse by detonation explosive overpressure. An open circuit condition will obtain if safing fuse 96 is destroyed without the leads thereof contacting housing 70. Following the initiation of the firing sequence, controller 200 is placed in the test mode and the deviation in voltage measurement device 210 is determined. If the post fire voltage deviation is within specified boundaries, a pass indication is obtained; otherwise, a fail indication is obtained. A pass indication verifies that initiator cartridge 30 has functioned properly.

Thus, the system of the present invention has the ability to perform system tests to assure: (1) operational status of safing fuse 96; (2) proper installation of all wireline and tool electrical interconnection points; and (3) detection of detonation immediately following application of the firing signal. The actual circuitry of the system is conventional and details need not be set forth to those skilled in the art.

Controller 200 and initiation cartridge 30 are designed to operate using a unique high frequency AC signal which is specific to the system, is not common to normal DC and 50/60 -Hz power sources, is well below normal communication and RF frequencies associated with transmitting devices, and is not otherwise available on well platforms. This minimizes the possibility of a stray signal unintentionally causing detonation. In addition, high pass filter 244 is uniquely designed to reject 50/60 -Hz AC signals up to 130 Vrms and DC voltages up to 180 V, without presenting a safety hazard. As such, high pass filter 244 has both a DC response characteristic for the performance of the prefire and post fire system tests and a high pass response with a corner frequency several orders of magnitude from the standard 50/60 -Hz power line frequency. At higher AC and DC voltage levels, overvoltage protection circuit 242 is employed to safe initiation cartridge 30 by monitoring the peak input voltage applied to initiation cartridge 30 and, if the voltage is above the overvoltage threshold, the overvoltage protection circuit converts to a low impedance, thus drawing sufficient current through safing fuse 96 to cause it to open circuit and render initiation cartridge 30 safe. An intended firing signal is generated by applying voltage to power supply circuit 232 which powers high frequency and output driver circuitry 234 to place a high frequency signal actuating signal on wireline 36.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense. It is also to be understood that the following claims are intended to cover all of the generic and specific features of the invention herein described and all statements of the scope of the invention which, as a matter of language, might be said to fall therebetween.

We claim:

1. An environmentally insensitive detonator initiation system for use in a well completion operation, comprising:

(a) a surface-located initiation system controller to output a unique electrical control signal, said initiation system controller including therein operational safety and interlock circuitry, and said unique electrical control signal having a frequency on the order of about 900 Hz and a voltage on the order of about 350 V; and (b) a downhole-located initiation cartridge to receive said unique electrical control signal and to detonate a pyrotechnic tool in response thereto, said initiation cartridge including therein safety circuitry to prevent detonation of said pyrotechnic tool in response to said initiation cartridge receiving other than said unique electrical control signal.

2. A method of activating an environmentally insensitive detonator initiation system for use in a well completion operation, comprising:

(a) providing a surface-located initiation system controller to output a unique electrical control signal, said initiation system controller including therein operational safety and interlock circuitry, and said unique electrical control signal having a frequency on the order of about 900 HZ and a voltage on the order of about 350 V;

(b) providing a downhole-located initiation cartridge to receive said unique electrical control signal and to detonate a pyrotechnic tool in response thereto, said initiation cartridge including therein safety circuitry to prevent detonation of said pyrotechnic tool in response to said initiation cartridge receiving other than said unique electrical control signal; and (c) providing said unique electrical control signal from said initiation system controller to said initiation cartridge.

* * * * *